US005417185A

United States Patent [19]

Beattie

[11] Patent Number: 5,417,185

[45] Date of Patent: May 23, 1995

[54] VARIABLE COMPRESSION PISTON

[76] Inventor: John F. E. Beattie, 2711 Crawford Rd. NW., Calgary, Alberta, Canada, T2L 1C9

[21] Appl. No.: 159,208

[22] Filed: Nov. 30, 1993

[30] Foreign Application Priority Data

Feb. 18, 1993 [CA] Canada ..... 2089815

[51] Int. Cl.[6] ..... F02D 15/02

[52] U.S. Cl. ..... 123/48 B; 123/78 B

[58] Field of Search ..... 123/48 B, 78 B, 78 BA, 123/78 E

[56] References Cited

U.S. PATENT DOCUMENTS

| | | | |
|---|---|---|---|
| 4,687,348 | 8/1987 | Naruoka et al. | 13/48 B |
| 4,721,073 | 1/1988 | Naruoka et al. | 123/48 B |
| 4,721,073 | 1/1988 | Narouka et al. | 123/48 B |
| 4,830,517 | 5/1989 | Naruoka et al. | 123/48 R |
| 4,864,975 | 9/1989 | Hasegawa | 123/48 B |
| 5,178,103 | 1/1993 | Simko | 123/48 B |

FOREIGN PATENT DOCUMENTS

| | | |
|---|---|---|
| 870075783 | 10/1987 | Australia . |
| 58-067937 | 4/1983 | Japan . |
| 60-081431 | 5/1985 | Japan . |
| 60-142020 | 7/1985 | Japan . |
| 61-291736 | 12/1986 | Japan . |
| 62-035034 | 2/1987 | Japan . |

*Primary Examiner*—Noah P. Kamen

[57] ABSTRACT

In an internal combustion engine, an eccentric bearing (16) located between the connecting rod (14) and the piston pin (12) can be used to vary the compression ratio. In this invention the eccentric bearing is held in any position by a continuously variable hydraulic lock. The hydraulic lock is controlled by a valve assembly (30) which can fix or release the lock bar (18). When the lock bar is released the eccentric bearing can turn as a result of the upward or downward inertia and gas pressure forces on the piston (10). However, a check valve (34) in the valve assembly allows it to turn only in the direction set by the valve assembly until it reaches the new position and re-locks. Engine oil is provided at regulated pressures through oil passages in the connecting rod, eccentric bearing and piston pin to set the position of the valve assembly and to provide a supply for the hydraulic lock. The oil pressure is controlled by an engine-management computer and the position of the valve assembly is set by pressures which are varied within the normal operating limits of the engine. Advantages are continuous variability, little change to existing engine components, low parts count, relatively low addition to reciprocating weight, and no chance of failure due to partial engagement, impact or wear.

7 Claims, 6 Drawing Sheets

VARIABLE COMPRESSION PISTON

BACKGROUND

1. Field of Invention

This invention relates to an apparatus for varying the compression ratio of an internal combustion engine while running.

2. Description of Prior Art

The efficiency of an internal combustion engine is related to its compression ratio. The selection of too low a ratio reduces power and efficiency. The selection of too high a ratio increases octane requirements and eventually causes knocking with its accompanying power loss and possibility of engine damage. The ability to adjust the compression ratio while the engine is running permits the engine to be operated with improved efficiency over a wide throttle range, with a wide octane range and, in the case of turbocharged or supercharged engines, with higher boost than could normally be used.

Although many patents have been filed in this area there appear to be no commercially successful designs. Some patents use the rotating eccentric bearing method (between the piston pin and connecting rod) to vary the compression ratio by raising or lowering the piston on the connecting rod. Most of these rely on the fact that there are upward and downward inertia and gas pressure forces on the piston which can be used to rotate the bearing to a new position.

The following patents are typical of those based on using the forces on the piston to rotate an eccentric bearing with hydraulically driven locking pins to engage a high or low position: U.S. Pat. No. 4,687,348 dated Aug. 18, 1987 and titled DEVICE FOR LOCKING/UNLOCKING ROTATION OF AN ECCENTRIC BEARING USED IN A COMPRESSION RATIO CHANGING MECHANISM OF AN INTERNAL COMBUSTION ENGINE; U.S. Pat. No. 4,721,073 dated Jan. 26, 1988 and titled COMPRESSION RATIO CHANGING DEVICE USING AN ECCENTRIC BEARING FOR AN INTERNAL COMBUSTION ENGINE; U.S. Pat. No. 4,830,517 dated May 16, 1989 and titled DEVICE FOR LOCKING ROTATION OF AN ECCENTRIC BEARING OF A COMPRESSION RATIO CHANGING DEVICE; U.S. Pat. No. 4,864,975 dated Sep. 12, 1989 and titled COMPRESSION RATIO CHANGING DEVICE FOR INTERNAL COMBUSTION ENGINE. While all of the above patents are based on hydraulically driven locking pins, the first three listed deal specifically with the problems of high impact, deformation and reliability due to partial engagement of the pins when changing from one locking position to another.

OBJECTS AND ADVANTAGES

It is desirable to have an eccentric bearing locking mechanism which avoids the need for locking at discrete positions and which does not require a positive mechanical engagement to be completed. By avoiding the need for discrete locking positions a continuous range of compression ratios becomes possible, and by avoiding the need for a positive mechanical engagement the possibility of failure due to incomplete engagement is eliminated. The present invention uses a continuously variable hydraulic lock to accomplish these objectives.

DRAWING FIGURES OF THE PREFERRED EMBODIMENT OF THE INVENTION

In the drawings which illustrate the preferred embodiment of the invention;

REFERENCE NUMERALS IN DRAWINGS

| | | | |
|---|---|---|---|
| 10 | piston | 12 | piston pin |
| 14 | connecting rod | 16 | eccentric bearing |
| 18 | lock bar | 20 | lock flange |
| 22 | lock enclosure | 24 | lock enclosure component |
| 26 | cap screws | 30 | valve assembly |
| 32 | inlet chamber | 34 | outlet chamber |
| 35 | check valve | 36 | ball |
| 38 | spring | 39 | passage |
| 40 | oil ports | 42 | oil channels |
| 50,51,52 | oil passages | 54 | reservoir |
| 60 | return spring | 62 | retainer |
| 64 | cap screw | | |

DESCRIPTION OF THE PREFERRED EMBODIMENT—FIGS. 1 to 9

Figure 1:
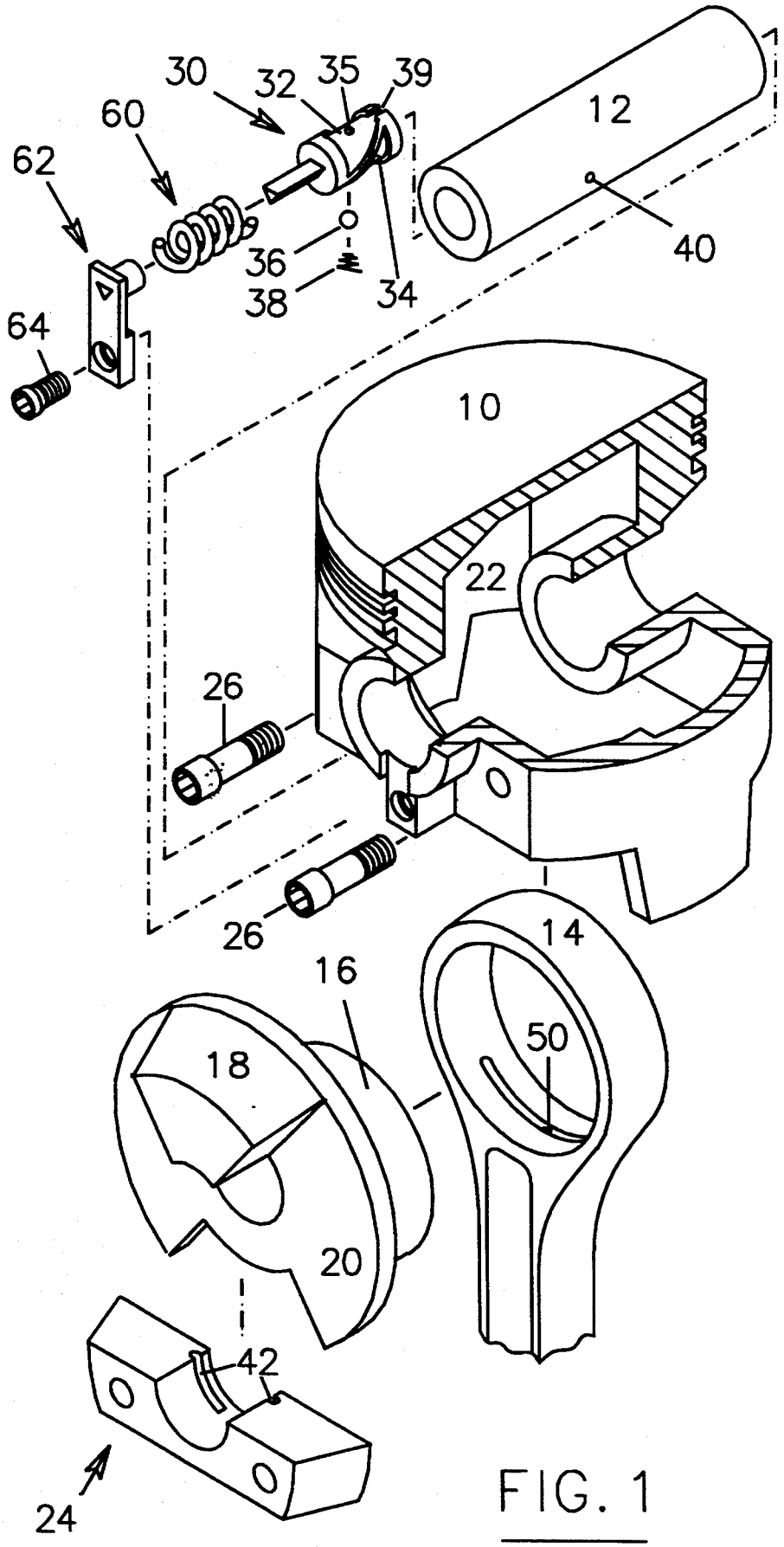
FIG. 1 is an exploded and partially sectioned view showing all the components.
Figure 2:
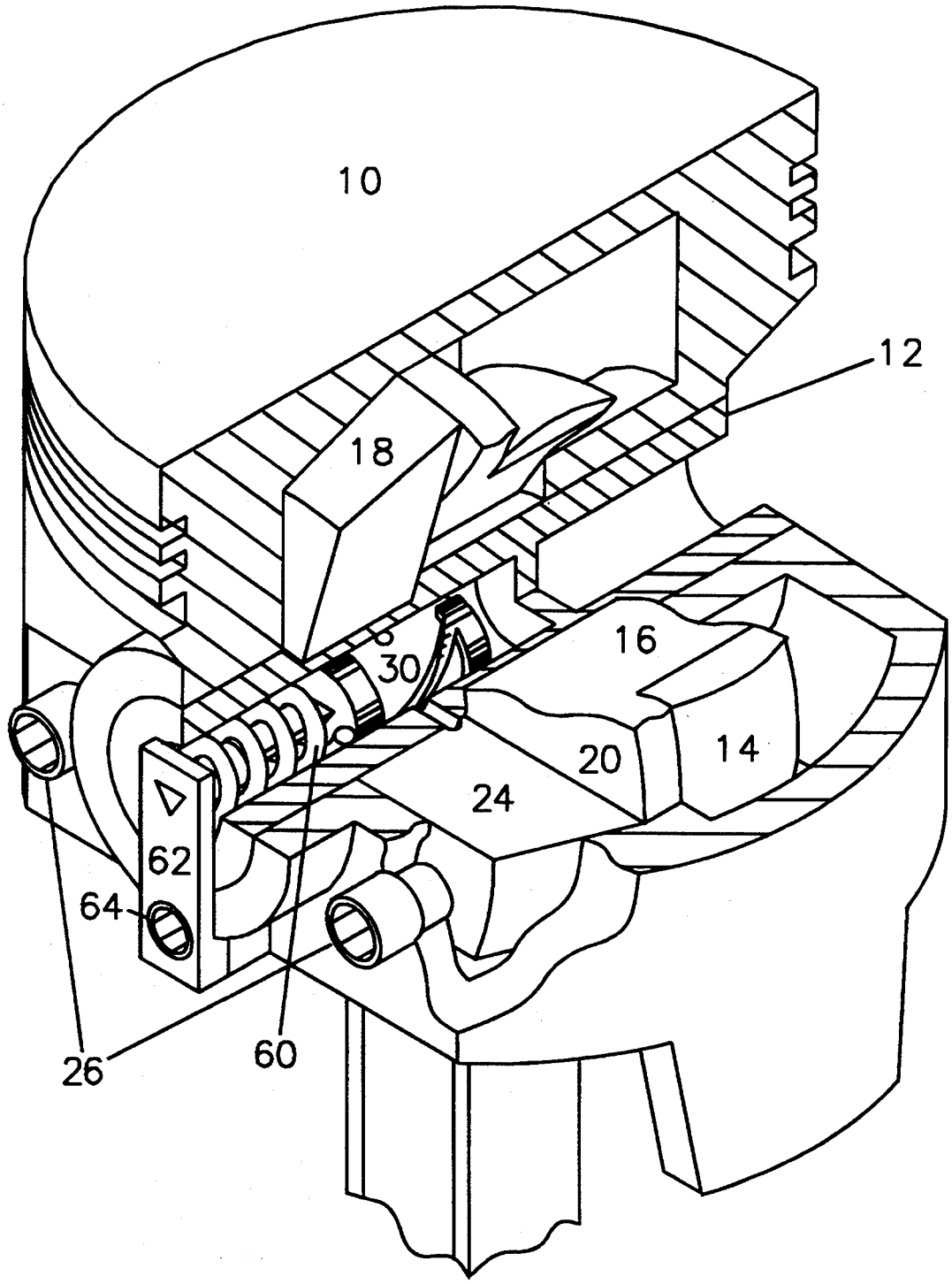
FIG. 2 is a partially sectioned view showing the assembled piston and the position of the components.
Figure 3:
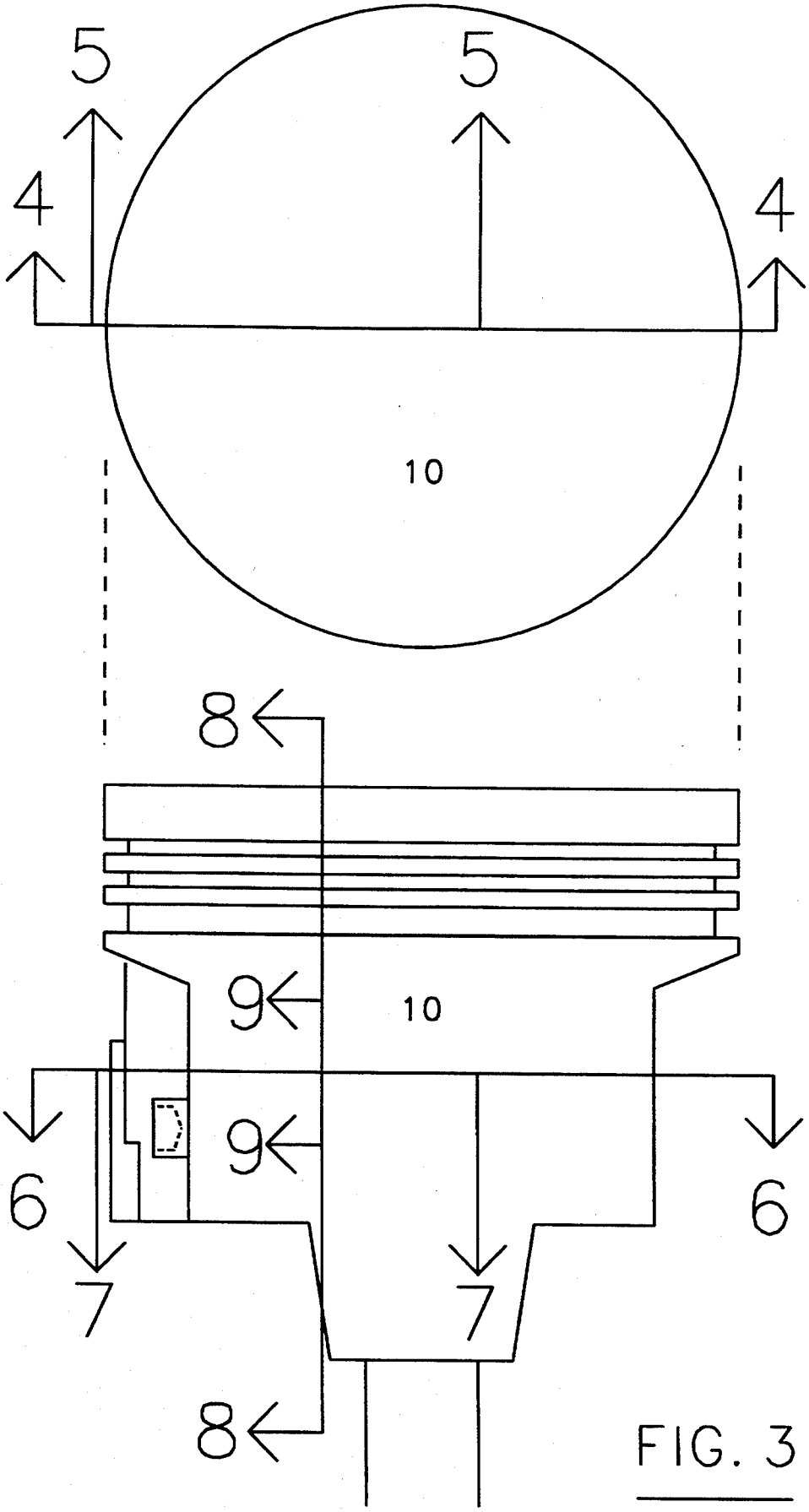
FIG. 3 is a reference view of the piston locating the sectional views.
Figure 4:
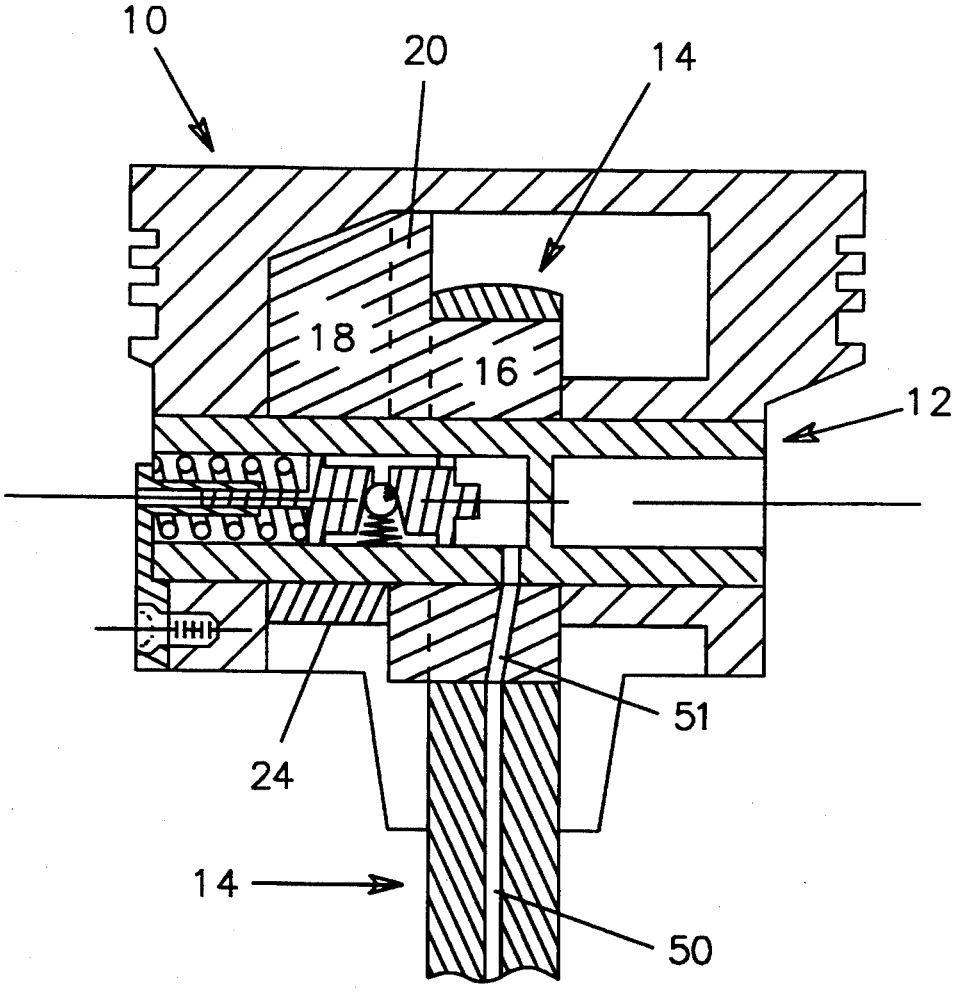
FIG. 4 is a sectional view from the side of the assembled piston.

Referring to FIG. 1 except where otherwise specified, the preferred embodiment of the invention shown comprises a piston 10, a piston pin 12, a connecting rod 14.

Inserted between the piston pin and the connecting rod is an eccentric bearing 16 which, in this embodiment is, combined with a lock bar 18 and lock flange 20. Part of the lock flange is not used and can been removed to save mass. The lock bar as shown in this embodiment is wedge-shaped both to increase strength and to exhaust the maximum amount of oil from its enclosure when either end of the rotation is reached. The eccentric bearing should be offset on the major thrust-surface side of the piston, providing the equivalent of piston pin offset.

The lock enclosure 22 is a space which in this embodiment is created by the piston, the piston pin, the lock flange and a lock enclosure component 24. This enclosure component is positioned before the piston pin is inserted and must be secured in some manner such as the two cap screws 26 to prevent it from rotating. The lock enclosure is divided into two compartments (see FIG. 8) by the lock bar, and the working surfaces between the lock bar, lock flange, piston, piston pin and enclosure component must be sufficiently close to form an effective seal.

Figure 5:
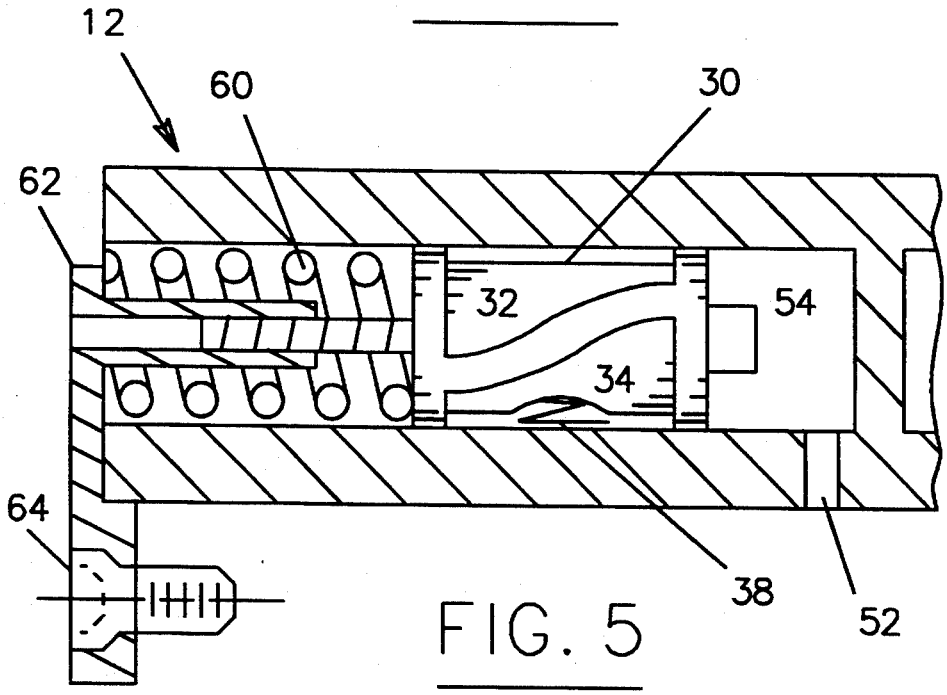
FIG. 5 is an partially sectioned enlargement of the sectional view of the piston pin and valve assembly from FIG. 4, showing details of the valve assembly.
Figure 6:
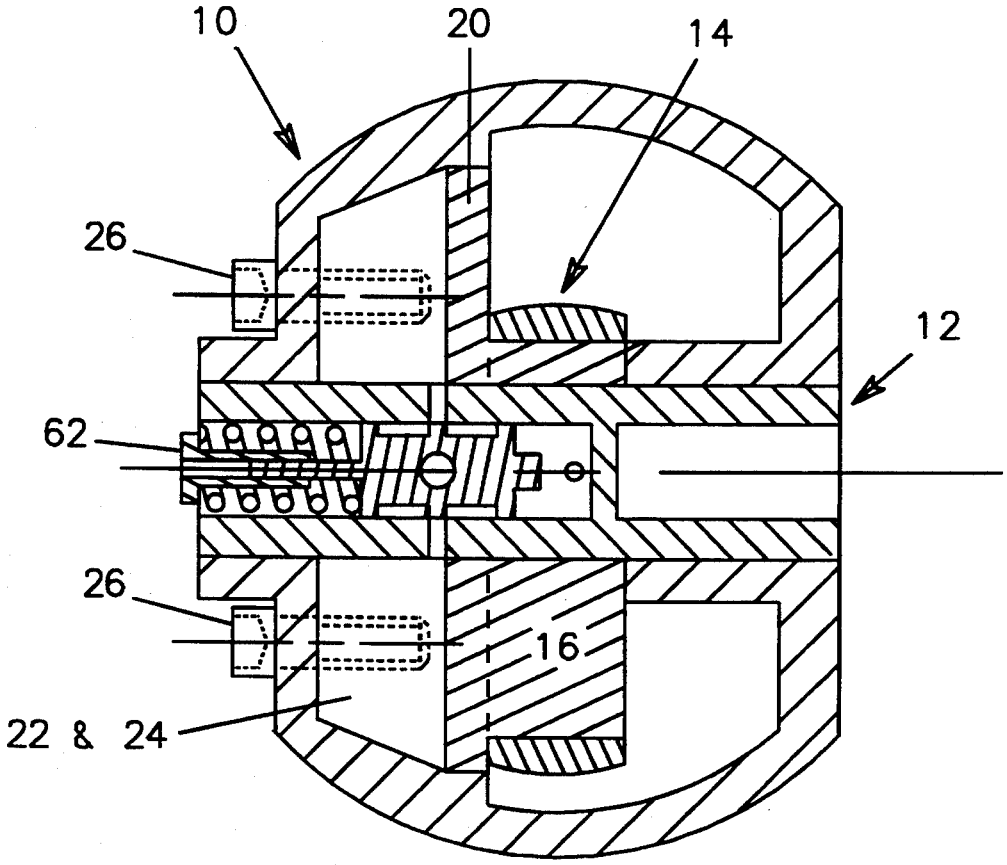
FIG. 6 is a sectional view from the top of the assembled piston.
Figure 7:
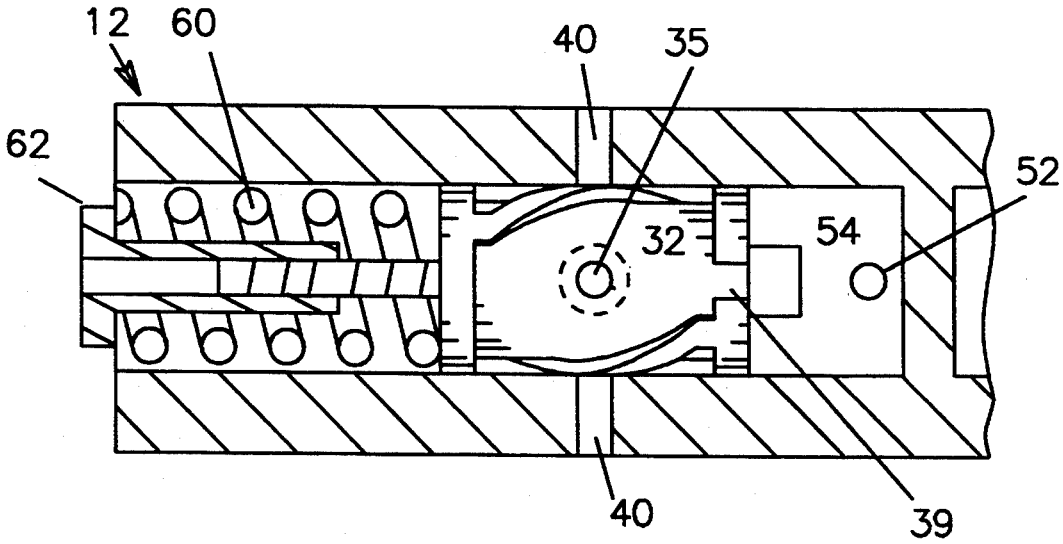
FIG. 7 is an partially sectioned enlargement of the sectional view of the piston pin and valve assembly from FIG. 6, showing details of the valve assembly.
Figure 8:
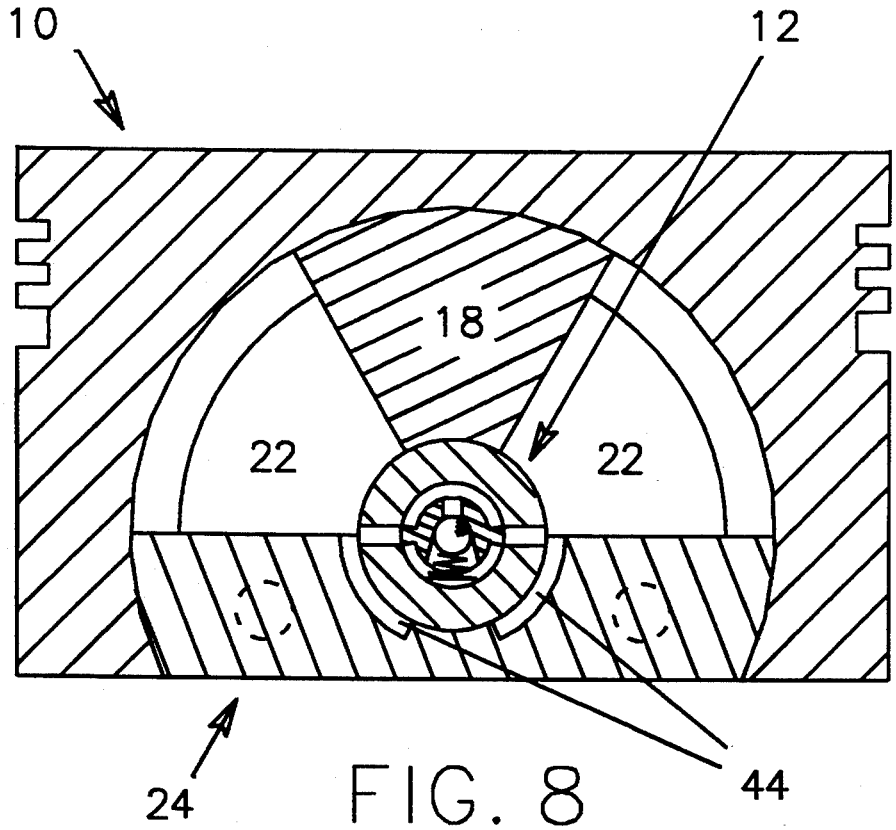
FIG. 8 is a sectional view of the assembled piston showing the lock bar, lock enclosure and valve assembly.
Figure 9:
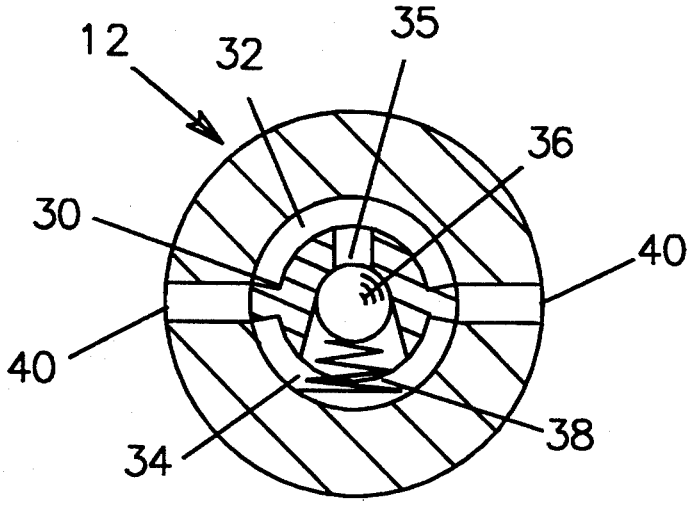
FIG. 9 is an enlargement of the sectional view of the valve assembly from FIG. 8, showing details of the one way valve in the valve assembly.

The valve assembly 30 has a body with an inlet chamber 32 and an outlet chamber 34 (best seen in FIGS. 5 and 8). The outlet chamber is connected to the inlet chamber through a check valve 35 (FIG. 9), (such as ball 36 and spring 38) so that the oil can only flow from the inlet chamber to the outlet chamber. Additional oil is supplied to the inlet chamber through passage 39. The valve assembly can slide in the piston pin under the pressure of the incoming oil supply.

The piston pin has two oil ports 40 which can be either inlet or outlet. The piston pin is fixed (normally press fitted) to the eccentric bearing and lock flange to maintain alignment of the oil ports with the lock bar. The two channels 42 in the enclosure component allow oil to flow to the two oil ports in the piston pin when the lock bar and piston pin are rotated.

The oil supply is provided through passages 50, 51, and 52 (see FIG. 4) in the connecting rod, eccentric bearing and in the piston pin to a reservoir 54 in the piston pin. The reservoir also supplies oil to the inlet chamber of the valve assembly to replenish lost oil.

Oil pressure in the reservoir slides the valve assembly against the return spring 60 in proportion to the pressure. The valve assembly is prevented from rotating by the retainer 62 which is secured by a fastener such as the cap screw 64. The valve assembly can travel only from the reservoir to the retainer. The return spring should be selected to permit the valve assembly to begin moving when the oil pressure reaches a specified minimum operating level, and to reach the retainer when the pressure reaches a specified maximum operating pressure.

OPERATION OF THE PREFERRED EMBODIMENTS—FIGS. 1-9

Operation is as follows. The required compression ratio is normally set by an engine-management computer (not shown). The computer regulates the oil pressure (within the operating limits allowed) by a method (not shown) such as an adjustable relief valve. It is only necessary to regulate that part of the supply which affects the connecting rods. The oil pressure moves the valve assembly 30 against the return spring 60. The ports 40 in the piston pin 12 are then exposed to the inlet 32 and outlet 34 chambers of the valve assembly, and the lock bar 18 is free to rotate. When it rotates, it forces oil from the compartment on one side of the lock enclosure 22, through the valve assembly, to the compartment on other side of the lock enclosure. However, because of the check valve 35, the oil can only flow into the inlet chamber, then through the check valve to the outlet chamber, and then out to the other side of the lock enclosure. As a result the lock bar can rotate in only one direction. When the external forces on the piston are in that direction, the eccentric bearing 16, lock bar, and piston pin will rotate until the ports 40 are no longer exposed and will remain in that position until the valve assembly is moved again. If the valve assembly moves in the opposite direction, the piston-pin ports are exposed to the opposite chambers, and the direction in which the lock bar can rotate is reversed. If the lock bar moves out of position for any reason, it will automatically adjust to the correct position on the next favourable piston cycle. The engine-management computer should be programmed to anticipate some of the factors which can affect the oil pressure at the valve assembly, such as centrifugal pumping in the crankshaft, changes in leakage due to temperature related viscosity changes, etc. If the compression ratio differs from the setting required by the computer, the computer should determine this by a method such as knock sensing and make compensating adjustments.

In the preferred embodiment of the invention, the valve assembly is located within the piston pin. The piston pin has a passage to permit the supply of oil to the valve assembly and ports between the valve assembly to the lock enclosure. The piston pin is press fitted to the lock flange and eccentric bearing to maintain alignment.

In the preferred embodiment of the invention, the lock enclosure is shaped to maximize the swept volume of the lock bar, thereby reducing hydraulic pressures required in the enclosure. In this embodiment a conical section is used. The use of the piston, piston pin and lock flange as enclosing components increases the volume and reduces the mass and the component count.

In the preferred embodiment of the invention, the valve assembly positions the hydraulic lock and eccentric bearing to give the lowest compression at the minimum oil pressure and to increase to the highest compression as oil pressure increases. This permits the engine to be started at the lowest compression ratio.

Although only a single embodiment of the present invention has been described and illustrated above, the present invention is not limited to the features of this embodiments but includes all variations and modifications within the scope of the claims. These include the following:

OTHER ASPECTS OF THE INVENTION

As claimed in the claims, this invention consists of an apparatus for varying the compression in an operating internal combustion engine by locking an eccentric bearing in the required position with a continuously variable hydraulic lock. The eccentric bearing is positioned between the piston pin and the connecting rod and can rotate as a result of the upward or downward inertia and gas pressure forces on the piston, thereby permitting with a partial rotation, adjustment of the height of the piston relative to the connecting rod from a minimum height any amount up to a maximum height. The continuously variable hydraulic lock in combination with the eccentric bearing comprises a means for stopping the rotation of the eccentric bearing in any position without mechanical engagement. The hydraulic lock comprises compartments which together comprise a means for locking the hydraulic lock by the entrapment of oil within the compartments, or unlocking the hydraulic lock by releasing the oil to flow from one of the compartments to the other, so that the hydraulic lock by virtue of being attached to the eccentric bearing comprises a means to hold or release the eccentric bearing.

The invention also consists of a valve assembly which is positionally responsive to a pressure-regulated oil supply, which in combination with the hydraulic lock comprises a means for the entrapment or the release of the oil in the hydraulic lock, so as allow the hydraulic lock to move only toward a position determined by the positioning of the valve assembly.

The continuously variable hydraulic lock (to hold or release the eccentric bearing) comprises a lock bar and a lock enclosure (which forms the space in which the lock bar turns and which allows the positioning of the hydraulic lock), a valve assembly (to control the hydraulic lock), and a means for providing a pressure-regulated oil supply (to set the valve assembly and to provide a supply for the hydraulic lock). The normal forces on the piston are used to position the eccentric bearing, which is permitted by the hydraulic lock to turn only toward the position for the compression ratio required, and is held in place when that position is reached. The eccentric bearing can turn as a result of the upward or downward inertia and gas pressure forces on the piston and this changes the height of the piston on the connecting rod. The change is continuously variable from a minimum height any amount up to a maximum height as is determined by the offset of the eccentric bearing on the piston pin. The rotation of the eccentric bearing is limited to less than 180 degrees so that the upward or downward forces on the piston can always move the eccentric bearing. (This might not occur reliably if the eccentric bearing reached top or bottom dead center positions on the piston pin). The eccentric bearing is connected to, and would normally be fabricated as part of the lock bar. The lock bar can hold the eccentric bearing in position or can allow it to turn until a new position is reached.

The lock bar comprises surfaces which constitute a sliding hydraulic seal within the lock enclosure, and which provide the means, in combination with the eccentric bearing, for the lock bar to move within the lock enclosure so as to divide the lock enclosure into two variable compartments.

The lock enclosure comprises the piston, piston pin, and the lock flange, with inner surfaces which constitute a sliding hydraulic seal with the lock bar, and which fully enclose the lock bar. The lock enclosure permits the lock bar to be fixed or released in any position within the lock enclosure. This is done by restricting or permitting the passage of oil from the compartment on one side of the lock enclosure to the compartment on the other side through ports in the lock enclosure.

The lock bar, lock flange and eccentric bearing can be fabricated as one unit and are press fitted or keyed to the piston pin, so that the piston pin rotates with the eccentric bearing, lock flange, and lock bar. The piston pin is provided with oil ports which allow for the flow of oil in or out of the compartments, so that when the eccentric bearing rotates, the alignment of the oil ports with the compartments on each side of the locking bar locking bar is maintained.

The valve assembly comprises a sliding cylindrical valve body with an inlet chamber, a check valve and an outlet chamber. The chambers are defined on the exterior of the valve assembly and are delineated in part by two helical ridges which determine the locked position of the hydraulic lock. The perimeters of the chambers forming a sliding hydraulic seal with the piston pin. The valve assembly is housed in the piston pin and slides against a return spring inside the piston pin. The valve assembly can be set by the regulated oil pressure to permit the flow of oil from a port on one side of the lock bar through the valve assembly to a port on the other side. This releases the lock bar and allows the eccentric bearing to turn. A check valve is used between the inlet and outlet chambers of the valve assembly so that the oil can only flow in one direction. This allows the lock bar to turn only in the direction set by the valve assembly. When the lock bar has turned to the position set by the valve assembly, the oil flow is cut off at the ports and the hydraulic lock is again locked. As a result, when the valve assembly is reset, the lock bar and the eccentric bearing follow to the new position set by the valve assembly.

Engine oil is supplied at regulated pressures to the valve assembly through oil passages in the connecting rod, eccentric bearing and piston pin to set the valve assembly and replenish lost oil in the hydraulic lock as required. The only function of the regulated pressure is to set the valve assembly. The work required to do this is low and the valve assembly can be adjusted to any setting between its minimum and maximum settings by variations in the oil pressure which are within the operating limits for the engine. Any given position of the valve assembly corresponds to a specific compression ratio. The oil is also used to supply (but not drive) the hydraulic lock. The hydraulic lock does not depend on the oil pressure, but requires the oil supply. During operation, oil will escape past the working surfaces, especially at the high temperatures encountered in the piston. If the lock bar moves from the required position as a result of oil leakage, it will automatically return to the correct position on the next favourable cycle and the oil will be replaced by the incoming supply. The hydraulic pressure would normally be set by an engine-management computer which determines the compression ratio required. (The computer should use a method such as knock-sensing to correct for variations in the compression setting and combustion process).

SUMMARY, RAMIFICATIONS AND SCOPE

This is an invention for continuously varying the compression ratio of an operating internal combustion engine. It uses an eccentric bearing between the piston pin and the connecting rod and a hydraulic locking mechanism. The eccentric bearing can be held in any position by the hydraulic lock. The hydraulic lock is controlled by a valve assembly which is set by oil pressure. Engine oil is provided at regulated pressures to set the position of the valve assembly and to provide a supply for the hydraulic lock. Advantages are continuous variability, little change to existing engine components, low parts count, and no chance of failure due to partial engagement, impact or wear.

A number of patents have been filed using an eccentric-bearing method in which the eccentric is locked in place with a hydraulically controlled locking pin. These appear to be subject to failure due to partial engagement of the locking pins. This invention avoids the need for locking at discrete positions so a continuous range of compression ratios is possible, and does not require a positive mechanical engagement to be completed so the possibility of failure due to incomplete engagement is eliminated.

I claim:

1. A variable compression ratio device for an internal combustion engine, comprising:

a piston;

a piston pin;

a connecting rod with at least one internal oil passage;

an eccentric bearing positioned between said piston pin and said connecting rod which can rotate as a result of the upward or downward inertia and gas pressure forces on said piston, thereby permitting with a partial rotation, adjustment of the height of said piston relative to said connecting rod from a minimum height any amount up to a maximum height;

with the improvements of this invention comprising:

a continuously variable hydraulic lock, which in combination with said eccentric bearing comprises a means for stopping the rotation of said eccentric bearing in any position without mechanical engagement, and comprises compartments which together comprise a means for locking said hydraulic lock by the entrapment of oil within said compartments, or unlocking said hydraulic lock by releasing said oil to flow from one of said compartments to the other, so that said hydraulic lock by virtue of being attached to said eccentric bearing comprises a means to hold or release said eccentric bearing; and a valve assembly which is positionally responsive to a pressure-regulated oil supply, which in combination with said hydraulic lock comprises a means for the said entrapment or said release of said oil in said hydraulic lock, so as allow said hydraulic lock to move only toward a position determined by the positioning of said valve assembly.

2. An apparatus for varying the compression as claimed in claim 1, wherein said continuously variable hydraulic lock comprises a lock bar attached to said eccentric bearing, and a lock enclosure, said lock bar being housed by and operating within said lock enclosure.

3. An apparatus for varying the compression as claimed in claim 2, wherein said lock bar comprises surfaces which constitute a sliding hydraulic seal within said lock enclosure, and which provide the means, in combination with said eccentric bearing, for said lock bar to move within said lock enclosure so as to divide said lock enclosure into two variable compartments.

4. An apparatus for varying the compression as claimed in claim 2, wherein said lock enclosure comprises said piston, said piston pin, and a lock flange, with inner surfaces which constitute a sliding hydraulic seal with said lock bar, and which fully enclose said lock bar.

5. An apparatus for varying the compression as claimed in claim 4, wherein said lock bar, said lock flange and said eccentric bearing are fabricated as one unit and are press fitted to said piston pin, so that said piston pin rotates with said eccentric bearing, said lock flange, and said lock bar; and said piston pin is provided with oil ports which allow for the flow of said oil in or out of said compartments, so that when said eccentric bearing rotates, the alignment of said oil ports with said chambers on each side of said locking bar locking bar is maintained.

6. An apparatus for varying the compression as claimed in claim 1, wherein said valve assembly comprises a sliding cylindrical valve body having an inlet chamber, a check valve and an outlet chamber, said chambers being defined on the exterior of said valve assembly and delineated in part by two helical ridges which determine the locked position of said hydraulic lock, the perimeters of said chambers forming a sliding hydraulic seal with said piston pin, said valve assembly being housed in said piston pin and sliding against a return spring within said piston pin so that said valve assembly can be positioned by said regulated oil pressure to permit the flow of oil from said oil port on one side of said hydraulic lock into said inlet chamber, through said check valve to said outlet chamber and to said oil port on the other side of said hydraulic lock so as to permit said hydraulic lock to turn only in the direction of a position set by said valve assembly, whereupon it is again locked.

7. A variable compression piston comprising a piston, a piston pin, a connecting rod, an eccentric bearing inserted between said piston pin and said connecting rod, which can rotate as a result of upward or downward inertia and gas pressure forces on said piston, thereby permitting adjustment of the height of said piston relative to said connecting rod from a minimum height any amount up to a maximum height with a partial rotation, said eccentric bearing being attached to a hydraulic lock, which comprises a lock bar and a lock enclosure, which together constitute a means for stopping the rotation of said eccentric bearing, said lock bar being housed by and operating within said lock enclosure, said lock bar comprising surfaces which constitute a sliding hydraulic seal within said lock enclosure, and which allow said lock bar, while attached to said eccentric bearing, to move within said lock enclosure so as to divide said lock enclosure into two variable compartments which provide a means for said hydraulic lock to be locked by the entrapment of oil in said compartments on each side of said lock bar, and to be unlocked by permitting said oil to flow from one side of said lock bar to the other, so that said hydraulic lock can hold or release said eccentric bearing; said lock enclosure comprising said piston, said piston pin, and a lock flange, with surfaces which constitute a sliding hydraulic seal with said lock bar, and which fully enclose said lock bar, and which permits said hydraulic lock to operate in the manner described above, said hydraulic lock being controlled by a valve assembly which comprises a sliding cylindrical valve body having an inlet chamber, a check valve and an outlet chamber, said chambers being defined on the exterior of said valve assembly and delineated in part by two helical ridges which determine the locked position of said hydraulic lock, the perimeters of said chambers forming a hydraulic seal with said piston pin, said piston pin having two oil ports which can be either inlet or outlet and being press fitted to said eccentric bearing and said lock flange to maintain alignment of said oil ports with said hydraulic lock, said valve assembly being located in said piston pin and sliding against a return spring within said piston pin so that in combination with said piston pin it provides a means when positioned by oil pressure to permit the flow of said oil from said oil port on one side of said hydraulic lock into said inlet chamber, through said check valve to said outlet chamber and to said oil port on the other side of said hydraulic lock so as to permit said hydraulic lock to turn only in the direction of a position set by said valve assembly, whereupon it is again locked, and a means for connecting a pressure-regulated oil supply, which comprises passages in said connecting rod, eccentric, and piston pin and a reservoir in said piston pin which both supplies oil to said input chamber of said valve assembly and slides said valve assembly against said return spring, whereby said oil pressure slides said valve assembly against said return spring and said oil ports in said piston pin are then exposed to said inlet and outlet chambers of said valve assembly, and said hydraulic lock is free to rotate by forcing said oil from one side of said lock enclosure, through said valve assembly, to the other side of said lock enclosure, but only in the direction permitted by said check valve, so that said hydraulic lock can rotate only in that direction, and when said inertia and gas pressure forces on said piston are in that direction, said eccentric, hydraulic lock, and piston pin will rotate until said oil ports are no longer exposed and will remain in that position until said valve assembly is moved again, thereby permitting the adjustment of the compression ratio by said oil pressure.

* * * * *